US012311990B2

(12) United States Patent
Hogan

(10) Patent No.: US 12,311,990 B2
(45) Date of Patent: May 27, 2025

(54) GRADE CROSSING CONTROL SYSTEM AND METHOD FOR DETERMINING TRACK CIRCUIT IMPEDANCE

(71) Applicant: Siemens Mobility, Inc., New York, NY (US)

(72) Inventor: Brian Joseph Hogan, Temecula, CA (US)

(73) Assignee: SIEMENS MOBILITY, INC., New York, NY (US)

( * ) Notice: Subject to any disclaimer, the term of this patent is extended or adjusted under 35 U.S.C. 154(b) by 682 days.

(21) Appl. No.: 17/658,305

(22) Filed: Apr. 7, 2022

(65) Prior Publication Data

US 2023/0322283 A1 Oct. 12, 2023

(51) Int. Cl.
*B61L 29/30* (2006.01)
*B61L 29/28* (2006.01)

(52) U.S. Cl.
CPC ..... *B61L 29/30* (2013.01); *B61L 29/284* (2013.01)

(58) Field of Classification Search
CPC ..... B61L 29/28; B61L 29/284; B61L 29/286; B61L 29/288; B61L 29/30; B61L 39/32
See application file for complete search history.

(56) References Cited

U.S. PATENT DOCUMENTS

2004/0181321 A1* 9/2004 Fries ..... B61L 1/187 701/19
2014/0319285 A1 10/2014 Hogan

* cited by examiner

*Primary Examiner* — Robert J McCarry, Jr.

(57) ABSTRACT

A grade crossing control system includes a track transmitter configured to couple to rails of a railroad track, and a track receiver configured to couple to the rails of the railroad track, wherein the track transmitter comprises a signal source and an amplifier, and is configured to transmit a first signal to the rails, wherein the track receiver is configured to measure a second signal in response to the first signal, and wherein the track transmitter is configured to provide feedback measurement information of the first signal.

13 Claims, 3 Drawing Sheets

GRADE CROSSING CONTROL SYSTEM AND METHOD FOR DETERMINING TRACK CIRCUIT IMPEDANCE

BACKGROUND

1. Field

Aspects of the present disclosure generally relate to grade crossing control systems including railroad signal control equipment comprising for example a grade crossing predictor system and methods for determining track circuit impedance.

2. Description of the Related Art

Railroad signal control equipment includes for example a constant warning time device, also referred to as a grade crossing predictor (GCP) in the U.S. or a level crossing predictor in the U.K., which is an electronic device that is connected to rails of a railroad track and is configured to detect the presence of an approaching train and determine its speed and distance from a crossing, i.e., a location at which the tracks cross a road, sidewalk or other surface used by moving objects. The constant warning time device will use this information to generate a constant warning time signal for a crossing warning device.

A crossing warning device is a device that warns of the approach of a train at a crossing, examples of which include crossing gate arms, crossing lights (such as the red flashing lights often found at highway grade crossings in conjunction with the crossing gate arms), and/or crossing bells or other audio alarm devices. Constant warning time devices are typically configured to activate the crossing warning device (s) at a fixed time, also referred to as warning time (WT), which can be for example 30 seconds, prior to the approaching train arriving at the crossing.

Typical constant warning time devices include a transmitter that transmits a signal over a circuit, herein referred to as track circuit, formed by the track's rails, for example electric current in the rails, and one or more termination shunts positioned at desired approach distances, also referred to as approach lengths, from the transmitter, a receiver that detects one or more resulting signal characteristics, and a logic circuit such as a microprocessor or hardwired logic that detects the presence of a train and determines its speed and distance from the crossing. The approach length depends on the maximum allowable speed (MAS) of a train, the desired WT, and a safety factor.

Termination shunts are mechanical devices connected between rails of a railroad track arranged at predetermined positions corresponding to the approach length required for a specific WT for the GCP system. When a railroad vehicle, e.g. train, travels along a railroad track, crosses a termination shunt and enters the track circuit, the train's axles and/or wheels act as shunts and the signal of the rails, for example electric current in the rails, is short circuited. This feature or function of a train is herein referred to as shunting. Shunting provides a means of detecting the presence of the train and ultimately calculating speed and distance of the train from the railroad crossing.

SUMMARY

Briefly described, aspects of the present disclosure relate to railroad crossing control systems including railroad signal control equipment comprising for example a grade crossing predictor (GCP) system and methods for determining track circuit impedance including signal source alignment, specifically current source alignment.

A first aspect of the present disclosure provides a grade crossing control system comprising a track transmitter configured to couple to rails of a railroad track, and a track receiver configured to couple to the rails of the railroad track, wherein the track transmitter comprises a signal source and an amplifier, and is configured to transmit a first signal to the rails, wherein the track receiver is configured to measure a second signal in response to the first signal, and wherein the track transmitter is configured to provide feedback measurement information of the first signal.

A second aspect of the present disclosure provides a method for determining a track circuit impedance comprising transmitting a first signal to rails of a railroad track utilizing a signal source, measuring a second signal at the rails of the railroad track in response to the first signal, and obtaining feedback measurement information of the first signal.

DETAILED DESCRIPTION

To facilitate an understanding of embodiments, principles, and features of the present disclosure, they are explained hereinafter with reference to implementation in illustrative embodiments. In particular, they are described in the context of being grade crossing control systems including railroad signal control equipment comprising for example a grade crossing predictor (GCP) system and methods for determining track circuit impedance with signal source alignment, specifically current source alignment. Embodiments of the present disclosure, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
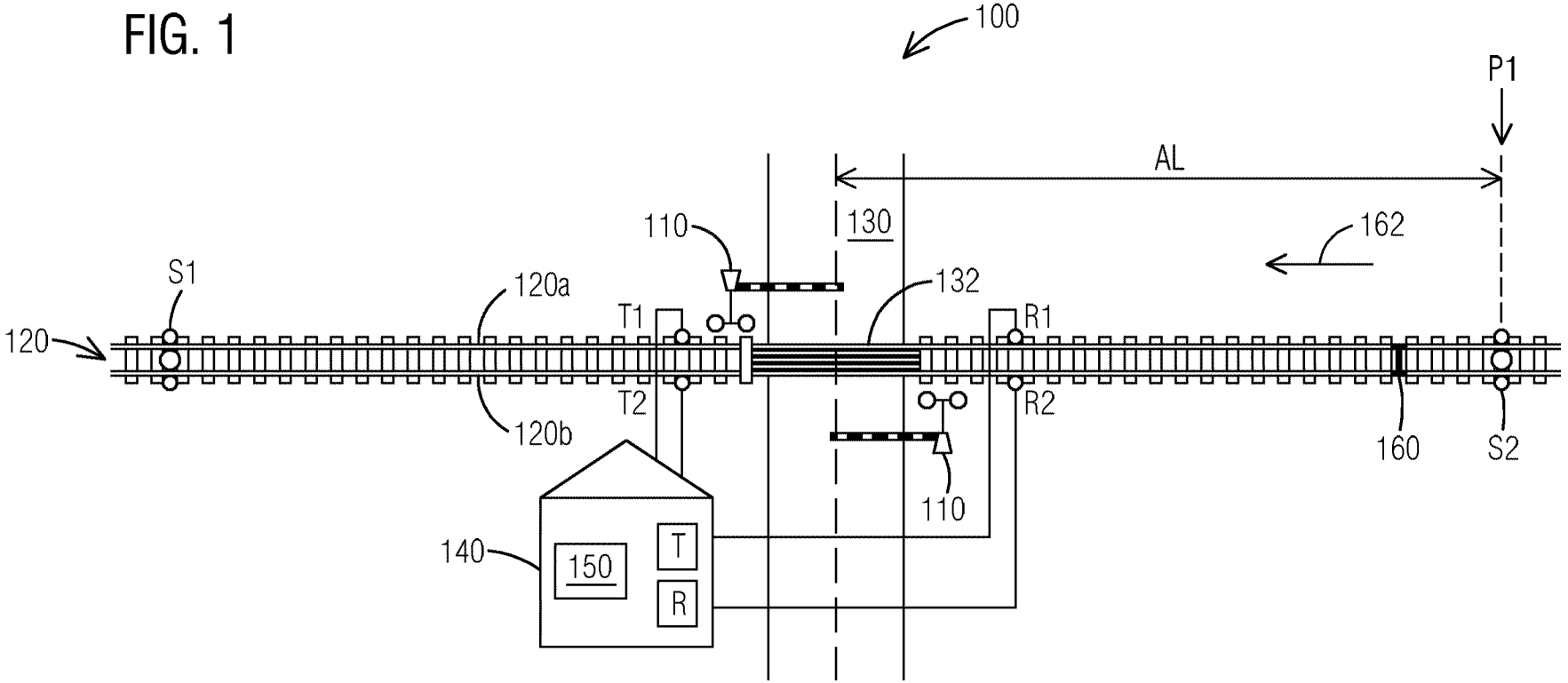
FIG. 1 illustrates a grade crossing control system in accordance with an exemplary embodiment of the present disclosure.

FIG. 1 illustrates a grade crossing control system 100 in accordance with an exemplary embodiment of the present disclosure. Road 130 crosses a railroad track 120. The crossing of the road 130 and the railroad track 120 forms an island 132. The railroad track 120 includes two rails 120*a*, 120*b* and a plurality of ties that are provided over and within railroad ballast to support the rails 120*a*, 120*b*.

Active protection systems for at—grade highway crossings, herein also referred to as highway crossings or simply crossings, in North and South America as well as in Australia are mainly based on so-called Predictor and Motion Sensor technology. An example for this technology is grade crossing predictor system 140, herein also referred to as GCP or GCP system 140, which comprises a track transmitter T that connects to the rails 120*a*, 120*b* at transmitter connection points T1, T2 on one side of the road 130 via transmitter wires. The GCP system 140 also comprises a track receiver R that connects to the rails 120*a*, 120*b* at receiver connection points R1, R2 on the other side of the road 130 via receiver wires.

The GCP system 140 includes a control unit 150 connected to the transmitter T and receiver R. The control unit 150 includes logic, which may be implemented in hardware, software, or a combination thereof, for calculating train speed, distance, and direction, and producing activation signals for warning devices 110 of the railroad crossing system 100. The control unit 150 can be for example integrated into a central processing unit (CPU) module of the GCP system 140 or can be separate unit within the GCP system 140 embodied as a processing unit such as for example a microprocessor.

Also shown in FIG. 1 is a pair of track circuit termination shunts S1, S2, herein also simply referred to as termination shunts or shunts S1, S2, one on each side of the island 132/road 130 at a desired distance from the center of the island 132. It should be appreciated that FIG. 1 is not drawn to scale and that both shunts S1, S2 are approximately the same distance away from the center of the island 132. The termination shunts S1, S2, are arranged at predetermined positions corresponding to an approach length AL required for a specific maximum authorized train speed and warning time (WT) for the GCP system 140. For example, if a total WT of 35 seconds (which includes 30 seconds of WT and 5 seconds of reaction time of the GCP system 140) at 60 mph maximum authorized speed (MAS) of a train is required, a calculated approach length AL is approximately 3900 feet (1200 m). Thus, the shunts S1, S2 are arranged each at 3900 feet from the center of the island 132. It should be noted that one of ordinary skill in the art is familiar with calculating the approach length AL. The termination shunts S1, S2 can be embodied for example as narrow band shunts (NBS).

Typically, the termination shunts S1, S2 positioned on both sides of the road 130 and the associated GCP system 140 are tuned to a same frequency. This way, the transmitter T can continuously transmit one AC signal having one frequency, the receiver R can measure the voltage response of the rails 120*a*, 120*b* and the control unit 150 can make impedance and constant warning time determinations based on the one specific frequency.

FIG. 1 further illustrates an exemplary axle 160 (with wheels) of a train within the track circuit. When the train, specifically the axle 160, crosses one of the termination shunts S1, S2, the train's wheels and axle(s) 160 act as shunts, which lower the impedance, as long as the train moves in the direction of the island 132 (illustrated by arrow 162), and voltage is measured by the GCP system 140, for example the receiver R. Determining/calculating the value of the impedance indicates the distance of the train and determining/calculating the rate of change of the impedance allows the speed of the train to be determined.

It should be noted that the term GCP system as used herein refers to many types or components of railroad control equipment suitable for controlling railroad/grade crossings and/or generating railroad/grade crossing activation signals. For example, the GCP system 140 can be configured to include predictor and motion sensor technology or can be configured to only include motion sensor technology. Further, the GCP system 140 can be configured as a type of constant warning time device. The GCP system 140 as used herein presents only an example of a system for generating railroad/grade crossing activation signals.

Figure 2:
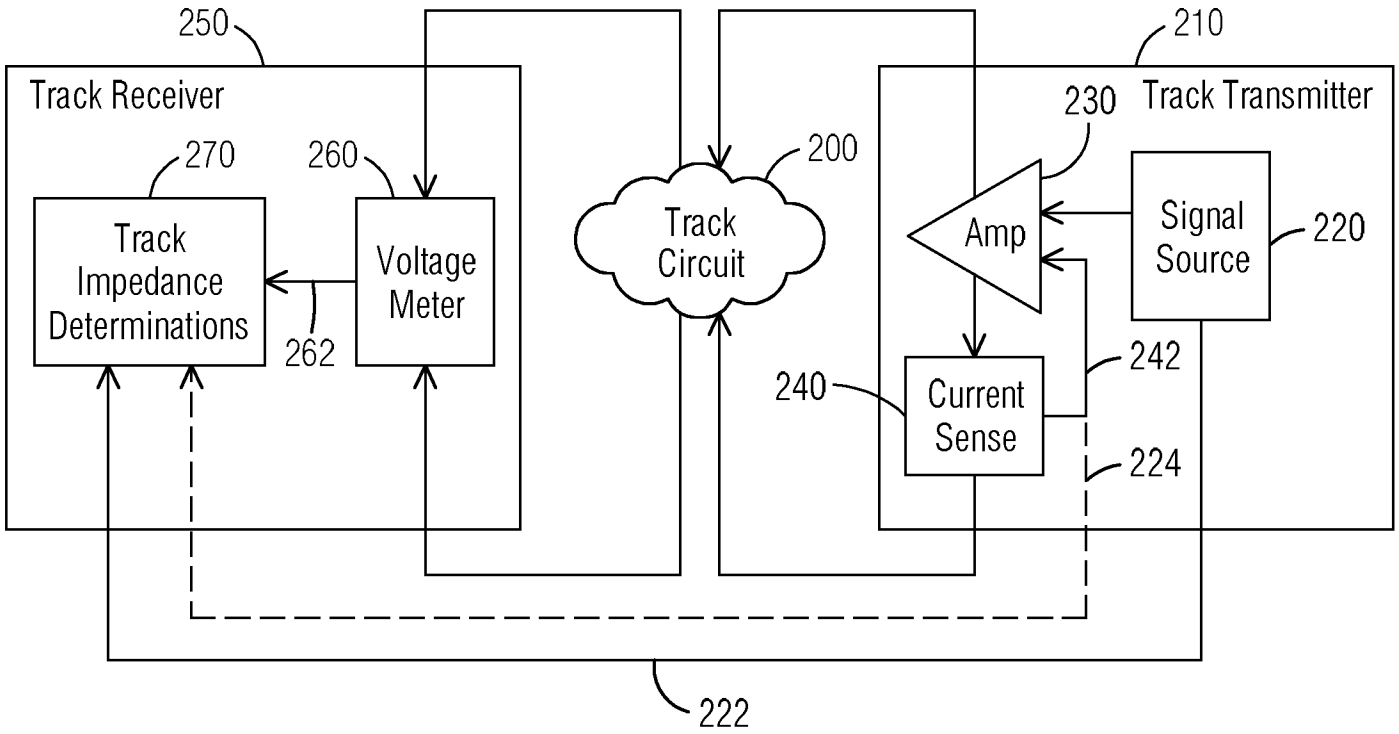
FIG. 2 illustrates a diagram of determining track circuit impedance in connection with a grade crossing control system in accordance with an exemplary embodiment of the present disclosure.

FIG. 2 illustrates a diagram of an arrangement for determining track circuit impedance in connection with a grade crossing control system, such as for example system 100 described with reference to FIG. 1, in accordance with an exemplary embodiment of the present disclosure.

As described earlier with reference to FIG. 1, track circuit 200, only shown schematically in FIG. 2, comprises multiple components, such as termination shunts S1, S2, GCP system 140, track transmitter 210 and track receiver 250. Track transmitter 210 and track receiver 250 are configured to be coupled to the rails 120*a*, 120*b* of the railroad track 120. Typically, the termination shunts S1, S2 and the associated GCP system 140, specifically track transmitter 210, are tuned to a same frequency.

The track transmitter 210 is configured to continuously transmit a first signal, for example a current signal (AC signal) having a specific frequency, and the track receiver 250 is configured to measure a second signal, for example a voltage signal, in response to the first signal. The GCP system 140 with track transmitter 210 and track receiver 250 is configured to make impedance determinations 270 and constant warning time determinations based on the specific frequency.

The track transmitter 210 comprises a signal source 220, specifically a current (alternating current, AC) source, and an amplifier 230 for the signal source 220, for generating, amplifying and transmitting the first signal, e.g. current signal, to the rails 120*a*, 120*b*. Further, the track transmitter 210 comprises current sense 240, wherein an output of the current sense 240, e.g. a measured actual current signal, is input to the amplifier 230 as feedback information 242. The track transmitter 210 provides a constant current at a specific frequency, i.e. the first signal, to the track circuit 200, specifically the rails 120*a*, 120*b* (see FIG. 1). The track receiver 250 measures a voltage produced at that specific frequency, for example using selective voltage meter 260, and with information on the current produced by the track transmitter 210, for example via signal information 222, calculates or determines track circuit impedance 270. It is important to note that the track transmitter 210 comprises signal source 220 and amplifier 230 for the signal source 220. However, with respect to certain measurements, for example current sense 240, the amplifier 230 introduces error and/or tolerance based on practical limitations in the design and external factors such as variations track impedance and other potential signals on the track circuit. Some compensation for deviation may be addressed in feedback 242 but appreciable error still exists.

In accordance with an exemplary embodiment of the present disclosure, the track transmitter 210 is configured to provide feedback measurement information 224 of the first signal to the track receiver 250. Specifically, the track transmitter 210 is configured to provide current signal feedback measurement 224 to the track receiver 250. The feedback measurement information 224 corresponds to the feedback information 242 provided by the current sense 240 and input to the amplifier 230.

The track receiver 250 is configured to measure a second signal in response to the first signal, and to determine a track circuit impedance 270 utilizing the first signal feedback measurement information 224 and second signal information 262. This means, that an actual current is measured and utilized for impedance determinations 270. In other words, actual current information (because feedback measurement information 224/242 is included) versus "desired" current information (without feedback information) is used for the track impedance determinations 270 or calculations.

The second signal information 262 comprises a voltage value, and wherein the track receiver 250 is configured to measure a voltage produced in response to the current signal (first signal) at the specific frequency, utilizing for example voltage meter 260. The track receiver 250 is configured to determine the track circuit impedance 270 utilizing the first signal feedback measurement information 224 and the second signal information 262 provided by voltage meter 260.

Utilizing the current signal feedback measurement 224 provides an improved accuracy of track impedance determinations, because the actual current (and not the 'desired current') is utilized for the track impedance determinations/calculations 270. The feedback measurement information 224 is directly transmitted to the track receiver 250.

Further, the track circuit 200 comprises predictor technology and/or motion sensor technology, such as for example GCP system 140, wherein a railroad vehicle travelling on the railroad track 120 causes a change of the track circuit impedance, and wherein the predictor technology and/or motion sensor technology is configured to generate grade crossing activation signals in response to the change of the track circuit impedance, utilizing the track impedance determinations 270.

Figure 3:
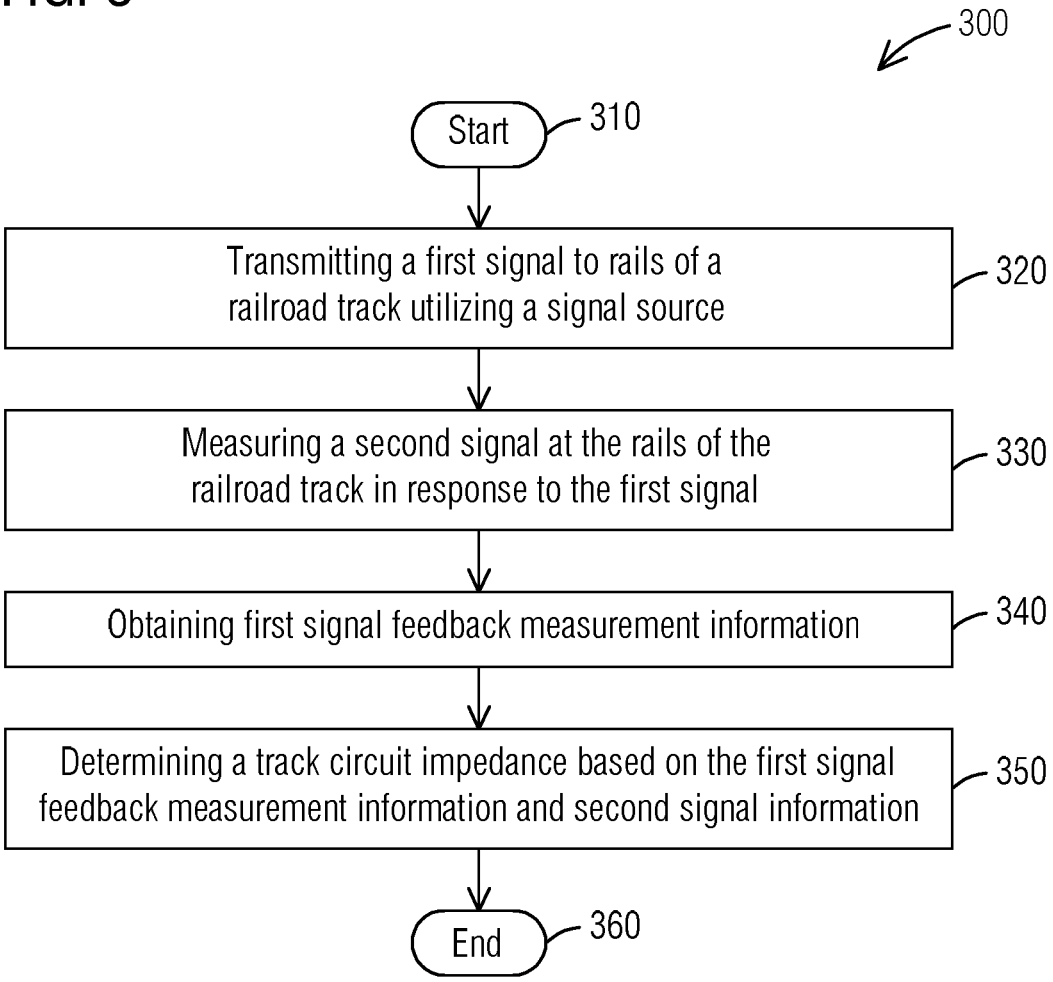
FIG. 3 illustrates a flow chart of a method for determining track circuit impedance in accordance with embodiments of the present disclosure.

FIG. 3 illustrates a flow chart of a method 300 for determining track circuit impedance in accordance with embodiments of the present disclosure. For example, the method 300 may be performed utilizing an arrangement of track circuit 200 as described with reference to FIG. 2.

While the method 300 is described as a series of acts or steps that are performed in a sequence, it is to be understood that the method 300 may not be limited by the order of the sequence. For instance, unless stated otherwise, some acts may occur in a different order than what is described herein. In addition, in some cases, an act may occur concurrently with another act. Furthermore, in some instances, not all acts may be required to implement a methodology described herein.

The method 300 may start at 310 and comprises an act 320 of transmitting a first signal to rails of a railroad track utilizing a signal source, an act 330 of measuring a second signal at the rails of the railroad track in response to the first signal, and an act 340 of obtaining first signal feedback measurement information. Further, the method 300 comprises an act 350 of determining a track circuit impedance based on the first signal feedback measurement information and second signal information. At 360, the method may end.

In an embodiment, the transmitting of the first signal to the rails (act 320) comprises generating the first signal from the signal source and amplifying the first signal utilizing an amplifier. In an example, the signal source comprises a current source and the first signal is a current signal at a specific frequency. The measuring of the second signal (act 330) comprises measuring a voltage produced in response to the current signal at the specific frequency.

The method 300 may further comprise generating grade crossing activation signals based on the track circuit impedance, wherein a railroad vehicle travelling on the railroad track causes a change of the track circuit impedance.

In another exemplary embodiment of the present disclosure, a non-transitory computer readable medium storing executable instructions is provided, wherein the executable instructions, when executed by a computer perform a method for determining track circuit impedance as described herein, specifically as described in method 300 with reference to FIG. 3.

It should be appreciated that acts associated with the above-described methodologies, features, and functions (other than any described manual acts) may be carried out by one or more data processing systems, such as for example control unit 150 of GCP system 140, via operation of at least one processor. As used herein, a processor corresponds to any electronic device that is configured via hardware circuits, software, and/or firmware to process data. For example, processors described herein may correspond to one or more (or a combination) of microprocessor, CPU, or any other integrated circuit (IC) or other type of circuit that is capable of processing data in a data processing system.

The control unit 150 and/or at least one processor that is described or claimed as being configured to carry out a particular described/claimed process or function may correspond to a CPU that executes computer/processor executable instructions stored in a memory in form of software and/or firmware to carry out such a described/claimed process or function. However, it should also be appreciated that such a processor may correspond to an IC that is hard wired with processing circuitry (e.g., an FPGA or ASIC IC) to carry out such a described/claimed process or function.

The invention claimed is:

1. A grade crossing control system comprising:

a track transmitter configured to couple to rails of a railroad track, and a track receiver configured to couple to the rails of the railroad track, wherein the track transmitter comprises a signal source and an amplifier, and is configured to generate and transmit a first signal to the rails utilizing the signal source and the amplifier, wherein the track receiver is configured to measure a voltage value produced in response to the first signal at the rails, wherein the track transmitter is configured to provide feedback measurement information of the first signal, and wherein the signal source comprises a current source and the feedback measurement information of the first signal is an actual current value at a specific frequency.

2. The grade crossing control system of claim 1, wherein the track receiver is configured to determine a track circuit impedance utilizing the feedback measurement information of the first signal and second signal information.

3. The grade crossing control system of claim 2, comprising predictor technology and/or motion sensor technology, wherein a railroad vehicle travelling on the railroad track causes a change of the track circuit impedance, and wherein the predictor technology and/or motion sensor technology is configured to generate grade crossing activation signals in response to the change of the track circuit impedance.

4. The grade crossing control system of claim 1, wherein the feedback measurement information of the first signal is directly provided to the track receiver.

5. The grade crossing control system of claim 1, wherein the track transmitter comprises an amplifier, wherein the signal source and the amplifier are configured to generate, amplify and transmit the first signal to the rails.

6. The grade crossing control system of claim 1, wherein the track transmitter comprises a current sense, and an output of the current sense is input to the amplifier to provide the feedback measurement information of the first signal.

7. The grade crossing control system of claim 1, wherein the second signal information comprises a voltage value, and wherein the track receiver is configured to measure a voltage produced in response to the current signal at the specific frequency.

8. A method for determining a track circuit impedance comprising:

transmitting a first signal to rails of a railroad track utilizing a signal source, measuring a voltage value at the rails of the railroad track in response to the first signal, and obtaining feedback measurement information of the first signal, wherein the signal source comprises a current source and the feedback measurement information of first signal comprises an actual current value at a specific frequency.

9. The method of claim 8, further comprising:

determining a track circuit impedance based on the feedback measurement information of the first signal and second signal information.

10. The method of claim 9, further comprising:

generating grade crossing activation signals based on the track circuit impedance, wherein a railroad vehicle travelling on the railroad track causes a change of the track circuit impedance.

11. The method of claim 8, wherein transmitting the first signal to the rails comprises generating the first signal from the signal source and amplifying the first signal utilizing an amplifier.

12. The method of claim 8, wherein measuring the second signal comprises measuring a voltage produced in response to the current signal at the specific frequency.

13. A non-transitory computer readable medium storing executable instructions that when executed by a computer perform a method for determining track circuit impedance as claimed in claim 8.

* * * * *